US005373354A

United States Patent [19]

Tadokoro et al.

[11] Patent Number: 5,373,354

[45] Date of Patent: Dec. 13, 1994

[54] COLOR ELECTROPHOTOGRAPHIC DEVICE AND METHOD

[75] Inventors: Hiroyuki Tadokoro; Isamu Terashima; Kazuhiro Wakamatsu, all of Hitachi, Japan

[73] Assignee: Hitachi, Ltd., Tokyo, Japan

[21] Appl. No.: 935,404

[22] Filed: Aug. 26, 1992

[30] Foreign Application Priority Data

Aug. 26, 1991 [JP] Japan ..... 3-236893

[51] Int. Cl.[5] ..... G03G 21/00

[52] U.S. Cl. ..... 355/311; 355/272; 355/275; 355/326

[58] Field of Search ..... 346/157; 355/272, 273, 355/274, 275, 326, 327, 311

[56] References Cited

U.S. PATENT DOCUMENTS

| | | | |
|---|---|---|---|
| 4,578,331 | 3/1986 | Ikeda et al. | 355/327 X |
| 4,652,115 | 3/1987 | Palm et al. | 355/274 |
| 4,788,572 | 11/1988 | Slayton et al. | 355/274 |
| 5,182,598 | 1/1993 | Hara et al. | 355/275 X |

FOREIGN PATENT DOCUMENTS

| | | |
|---|---|---|
| 55-38502 | 3/1980 | Japan . |
| 59-50460 | 3/1984 | Japan . |
| 60-17461 | 1/1985 | Japan . |
| 60-17462 | 1/1985 | Japan . |
| 60-252380 | 12/1985 | Japan . |
| 63-121870 | 5/1988 | Japan . |

*Primary Examiner*—Benjamin R. Fuller
*Assistant Examiner*—John Barlow
*Attorney, Agent, or Firm*—Antonelli, Terry, Stout & Kraus

[57] ABSTRACT

A color electrophotographic device includes, a color toner image producing device which produces a color toner image on a rotatable photo sensitive drum by forming four toner images thereon; an image transferring device which transfers the color toner image on the photo sensitive drum onto a recording medium; a fixing means which fixes the color toner image on the recording medium; a transferring device which transfers the recording medium; a recording medium selecting and feeding device which selects one of an ordinary paper and a transparent sheet to serve as the recording medium and feeds the selected one to the transferring device; and a control device which controls the operations of the devices referred to above and includes a first and a second control function which are rendered operative when the transparent sheet is selected as the recording medium, wherein the first control function causes the photo sensitive drum to perform one idle rotation before the image transferring device beings to transfer the color toner image carried on the photo sensitive drum onto the recording medium; and wherein the second control function causes the transferring device to reduce the transferring speed for the transparent sheet to a speed lower than that for the ordinary paper only during the operations of the image transferring device and the fixing means and the transferring speed reduction is accomplished after the last toner image has been formed on the photo sensitive drum and during the idle rotation thereof.

7 Claims, 6 Drawing Sheets

IN CASE OF ORDINARY PAPER

IN CASE OF TRANSPARENT SHEET

IN CASE OF ORDINARY PAPER

IN CASE OF TRANSPARENT SHEET

COLOR ELECTROPHOTOGRAPHIC DEVICE AND METHOD

BACKGROUND OF THE INVENTION

1. Field of the Invention

The present invention relates to a color electrophotographic device and method and, in particular, relates to a color electrophotographic device and method which include a control suitable for producing color picture images on transparent plastic sheets which are to be used for overhead projectors.

2. Description of Related Art

A color electrophotographic device produces color picture images through electrophotographic processes fundamentally by making use of a yellow (Y) series toner, a magenta (M) series toner, a cyan (C) series toner and a black (K) toner (in some cases the K toner is not used).

Examples of color electrophotographic devices and methods proposed up to now are as follows;

JA-A-60-17461(1985) and JP-A-60-17462(1985) which correspond to U.S. Pat. No. 4,578,331 disclose a multi overlaid development device and method wherein a toner image forming process is carried out in a multi overlaid manner on a photo sensitive drum (a primary recording medium) by making use of a Y series toner, an M series toner, a C series toner and a K toner to form a color toner image and then the formed color toner image is inclusively transferred and fixed on a secondary recording medium.

Further, U.S. Pat. No. 4,652,115 discloses an intermediate image transfer device and method wherein a Y series toner image, an M series toner image, a C series toner image and a K toner image are intermediately transferred in a multi overlaid manner to an intermediate image transfer medium to form a color toner image and then the formed color toner image is finally and inclusively transferred and fixed on a secondary recording medium.

Still further, JP-A-55-38502(1980) discloses a multi overlaid image transfer device and method wherein a Y series toner image, an M series toner image, a C series toner image and a K toner image held on an image transfer drum are transferred sequentially at every one rotation thereof onto a secondary recording medium in a multi overlaid manner to form and fix a color toner image thereon.

Still further, JP-A-59-50460(1984) discloses a tandem drum device and method wherein dedicated photo sensitive drums are provided for respective color toner images, latent images on the respective dedicated photo sensitive drums are developed with the respective dedicated toners to form respective color toner images thereon, and the respective toner images are sequentially transferred onto a secondary recording medium to form and fix a color toner image thereon.

Color electrophotographic devices using the above devices and methods could produce a desirable color picture image on an ordinary paper serving as a secondary recording medium, but could not produce a desirable color picture image on a transparent plastic sheet serving as a secondary recording medium.

When a transparent plastic sheet is used as a secondary recording medium, it is necessary to heighten the transmission factor of non-scattering light passing through a toner image for a desirable projection, and for this reason it is necessary to provide a sufficiently large energy for fixing toner images onto the transparent plastic sheet during the fixing process in comparison with that for an ordinary paper. For providing a large fixing energy for the transparent plastic sheet, measures such as a second fixing means for a transparent sheet and a retransfer mechanism for a transparent sheet which causes the transparent sheet to pass twice through the same fixing means were proposed. However, these measures included problems such as lower reliability and high cost because of an increased number of parts. Another measure contemplated was a method of reducing a second recording medium transferring speed during the fixing process when the second recording medium is a transparent sheet, however this method necessitated that the physical distance between the image transfer station and the fixing station be more than the length of the transparent sheet to be used in order to compensate for the speed difference between the image transfer process and the fixing process and caused a problem of increasing the size of the device. A further measure contemplated was to reduce the processing speed not only at the fixing process but also at all of the processes, but with this method respective specifications for an ordinary paper and a transparent sheet such as for a charging process, exposure process and development process in an electrophotographic process had to be separately determined which caused problems of increasing the complexity of the control of the device therefor and prolonging the production time of a color toner image.

SUMMARY OF THE INVENTION

An object of the present invention is to provide a color electrophotographic device and method selectively applicable to an ordinary paper and a transparent sheet which produce a desirable color picture image on both of these secondary recording mediums, i.e. the ordinary paper and the transparent sheet, while eliminating the problems indicated above.

A color electrophotographic device according to the present invention comprises a color toner image producing means which forms toner images in an overlaid manner over a rotary color toner image producing medium to produce a color toner image, an image transferring means which transfers the color toner image formed on the color toner image producing medium onto a recording medium, a fixing means which fixes the color toner image on the recording medium, a transferring means which transfers the recording medium, a recording medium feeding means which selectively feeds either an ordinary paper or a transparent sheet both serving as the recording medium to the transferring means and a control means for controlling the above mentioned means, wherein the control means includes a first and second control function which are operable when production of a color picture image on a transparent sheet is required, wherein the first control function causes the color toner image producing medium to perform at least one idle rotation between the toner image forming process for the last color toner and the image transferring process of the color toner image onto the transparent sheet when the color toner image is transferred and fixed on the transparent sheet, and the second control function controls the transferring speed of the transparent sheet during the image transferring process and the fixing process to a lower speed than that for the ordinary paper.

With the addition of the step of causing the color toner image producing medium on which a color toner image has been produced, to perform at least one idle rotation the sheet transferring speed can be reduced to a desired speed for fixing the color toner image onto the transparent sheet to thereby obtain a desired color picture image produced thereon without adversely affecting the operations of the other processes. Further, since only the transferring speed during the image transferring process and the fixing process is reduced to a desired speed, the color toner image producing time is not prolonged much in comparison with an instance where the processing speeds of all the processes are reduced. Still further, the transferring station and the fixing station can be arranged without any restriction with respect to their physical distance, thereby a color electrophotographic device of low cost and of small size is obtained.

BRIEF DESCRIPTION OF THE DRAWINGS

FIG. 2 (*b*) shows a timing chart with regard to the operation in case of a transparent sheet of the laser beam printer shown in FIG. 1;

FIG. 4 (*b*) shows a timing chart with regard to the operation in case of a transparent sheet of the laser beam printer shown in FIG. 3;

DESCRIPTION OF THE PREFERRED EMBODIMENTS

An embodiment in a form of a laser beam printer of a color electrophotographic device employing a multi overlaid development method according to the present invention is explained with reference to FIG. 1, FIG. 2 (*a*) and FIG. 2 (*b*).

Figure 1:
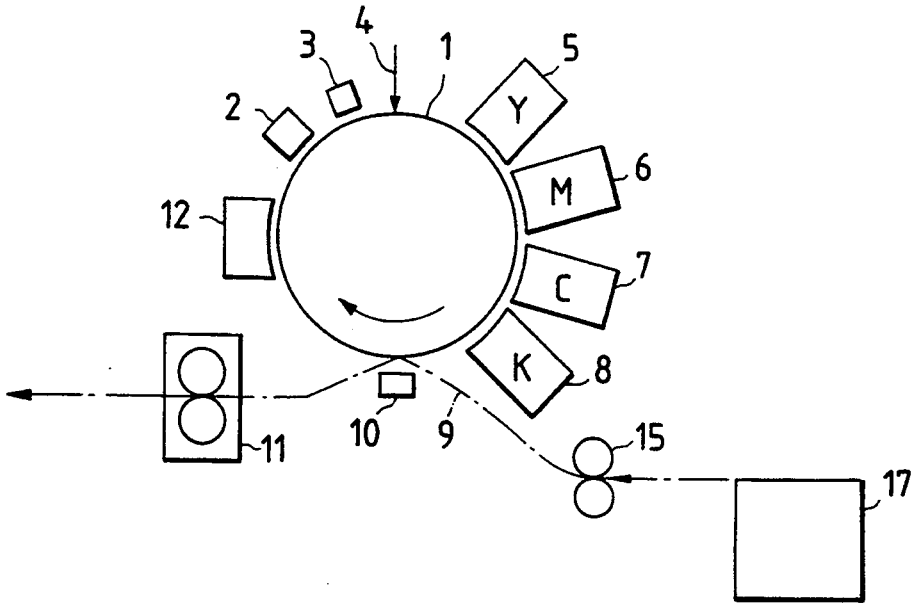
FIG. 1 is a schematic vertical cross sectioned side view of one embodiment of a color electrophotographic device employing a multi overlaid development method in a form of a laser beam printer according to the present invention.
Figure 2A:
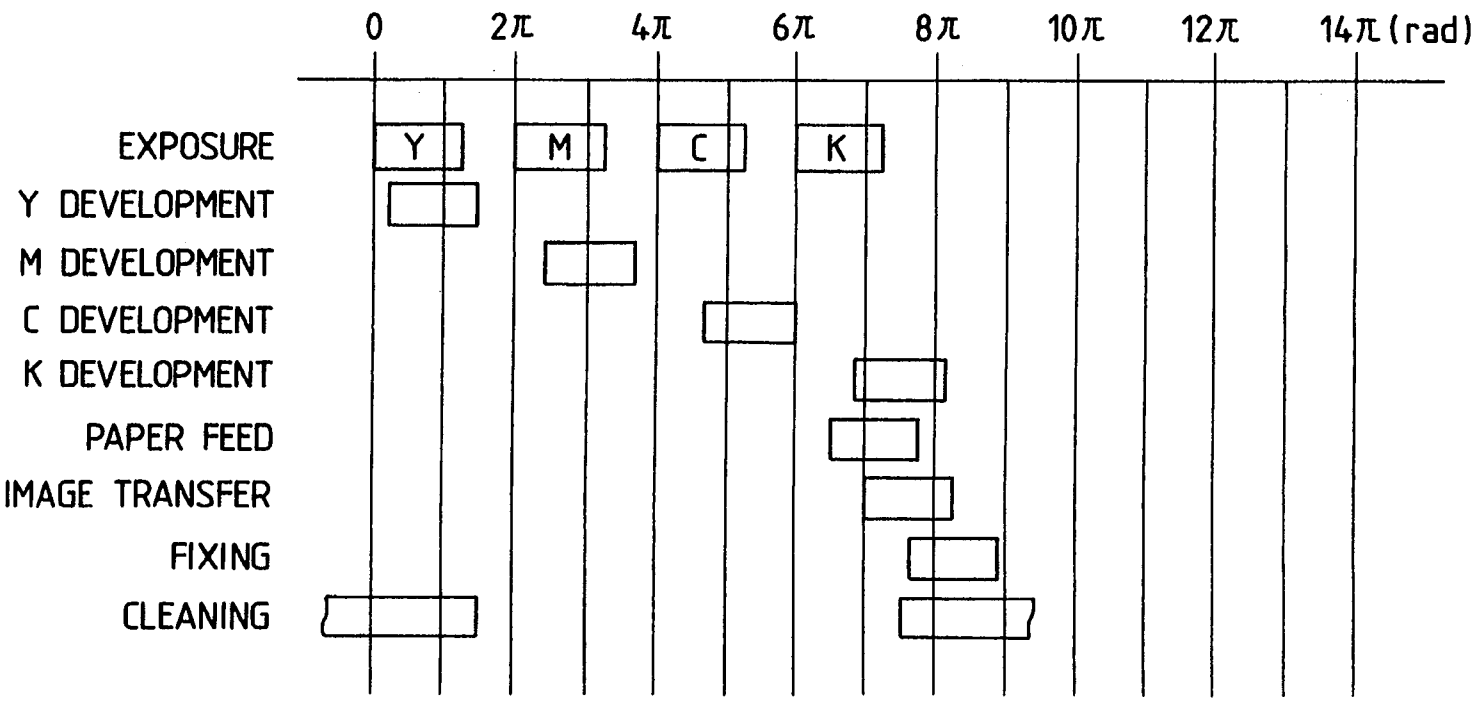
FIG. 2 (*a*) shows a timing chart with regard to the operation in case of an ordinary paper of the laser beam printer shown in FIG. 1.
Figure 2B:
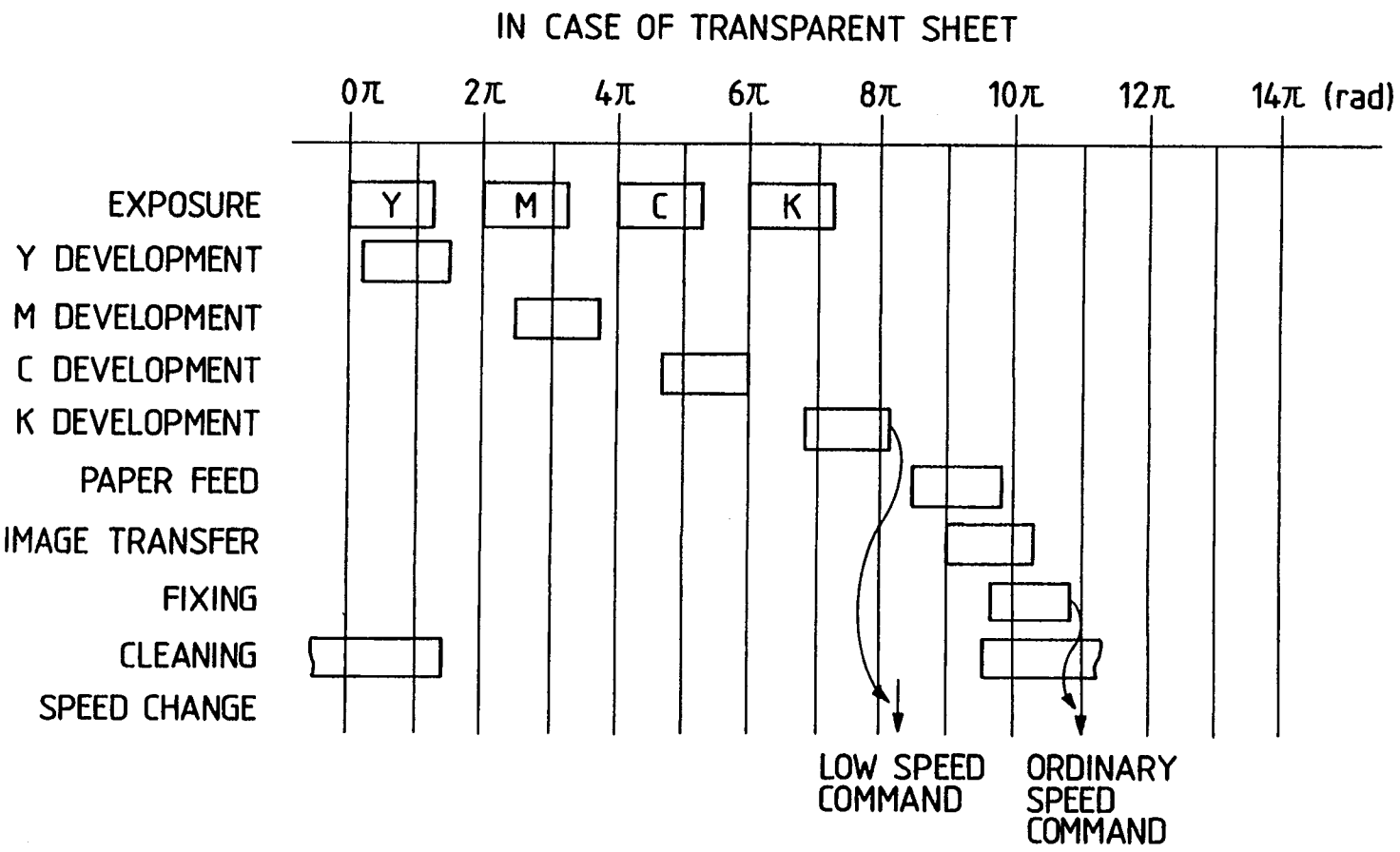

FIG. 1 shows a vertical cross sectioned side view thereof, and FIG. 2 (*a*) and FIG. 2 (*b*) show operation timing charts thereof. In the timing charts of FIG. 2 (*a*) and FIG. 2 (*b*), the time axes are represented by the rotation angle of a photo sensitive drum included in the laser beam printer and an angle $2\pi$ corresponds to one rotation thereof.

A photo sensitive drum 1 is uniformly charged over the surface thereof with a charger 3 after the residual toner on the surface is cleaned by a cleaner 12 and the remaining charges on the surface are neutralized by a charge eliminator 2. At rotation angle zero in the first rotation the photo sensitive drum 1 is begun to be exposed by an exposure beam 4 which is modulated by data with regard to a yellow (Y) color, and a latent image produced by the exposure is developed at a yellow (Y) developer 5 to thereby form a Y series toner image. The cleaner 12 is retreated and set to a rest state before the top end of the Y series toner image reaches the cleaner 12 (at rotation angle of $1.5\pi$) in order to prevent the cleaner 12 from erasing the toner images formed in the toner image forming processes.

Subsequently, at the second rotation (rotation angle of $2\pi$) the photo sensitive drum 1 is begun to be exposed by the exposure beam 4 which is then modulated by data with regard to a magenta (M) color, and a latent image produced by the exposure is developed at a magenta (M) developer 6 to thereby form a M series toner image. Thereafter, at the third rotation (rotation angle of $4\pi$) the photo sensitive drum 1 is initiated to be exposed by the exposure beam 4 which is then modulated by data with regard to a cyan (C) color, and a latent image produced by the exposure is developed at a cyan (C) developer 7 to thereby form a C series toner image. Finally, at the fourth rotation (rotation angle of $6\pi$) the photo sensitive drum 1 is initiated to be exposed by the exposure beam 4 which is then modulated by data with regard to a black (K) color, and a latent image produced by the exposure is developed at a black (K) developer 8 to thereby form a K toner image.

Through the above processes a four color toner image is developed on the photo sensitive drum 1 in a multi overlaid manner.

Subsequently, a transferring roller 15 is controlled in synchronization so that the transferring timing of a secondary recording medium through a recording medium transferring passage 9 matches with the four color toner image. However, the manner of control differs in the case when an ordinary paper is used as the secondary recording medium and in the case when a transparent sheet is used as the secondary recording medium.

In case when an ordinary paper is used as the secondary recording medium, in order to match the top end of the four color toner image which appears at the position of an image transferring unit 10 when the photo sensitive drum 1 rotates by rotating angle of $7\pi$, the transferring timing of the ordinary paper is synchronized to thereby transfer the four color toner images onto the ordinary paper via the image transferring unit 10. Thereafter, the four color toner image is fixed on the ordinary paper via a fixing unit 11 to obtain a color picture image printed matter. Then the retreated cleaner 12 is rendered operative to remove residual toner on the photo sensitive drum 1 which has completed transferring the four color toner image onto the ordinary paper.

On the other hand, in the case when a transparent sheet is used, it is necessary to provide a sufficiently large energy in the fixing process in comparison with that required for the ordinary paper as explained above, and control for the transparent sheet is performed by decreasing the transferring speed thereof. Specifically, according to several experimental results, when a transferring speed at the fixing unit 11 set for an ordinary paper was reduced lower than 75 mm/sec, a transmission factor of non-scattering light through a color picture image on the transparent sheet was increased.

However, when the transferring speed is simply reduced to a desired speed at the moment when the photo sensitive drum 1 reaches the rotating angle of $7\pi$, the exposure process for the data relating to a K color and the development process of a K toner both of which are being performed at that time are affected because the rotating speed of the photo sensitive drum 1 is simultaneously reduced. Therefore the speed reduction at this rotation is prevented and after the completion of the K toner development process the transferring speed is reduced to the desired speed and the device waits for the top end of the four color toner image to arrive at the position of the image transferring unit 10 in the subsequent rotation. Since the photo sensitive drum 1 is caused to perform one idle rotation, the timing when the cleaner 12 is again rendered operative is controlled to be delayed by the interval corresponding to the one idle rotation to prevent the four color toner image from being erased.

Then the transferring of a transparent sheet is initiated in synchronization with the rotation of the photo sensitive drum 1 in order to match the top end of the four color toner image which appears again at the position of the image transferring unit 10 when the photo sensitive drum 1 rotates by rotation angle of $9\pi$, and the four color toner image is transferred onto the transparent sheet via the image transferring unit 10. Thereafter, the four color toner image is fixed on the transparent sheet at the reduced transferring speed via the fixing unit 11 and a color picture image being an increased transmission factor of the non-scattering light is produced on the transparent sheet. After completing all the processes (in particular the fixing process) for the transparent sheet, the transferring speed is controlled to be set back to an ordinary speed determined for the ordinary paper.

Figure 5:
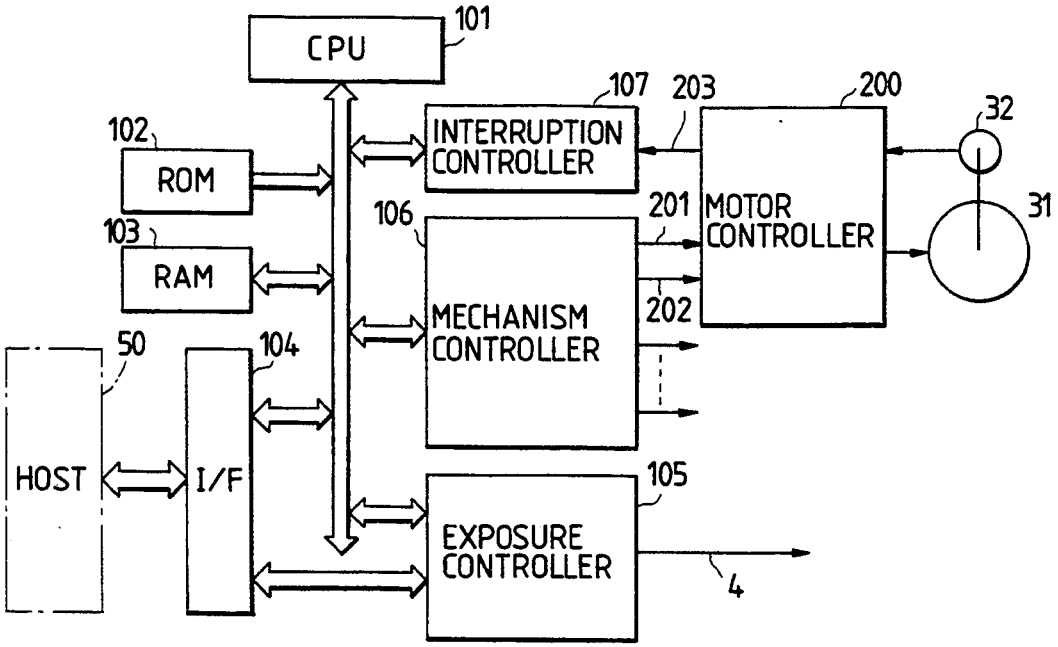
FIG. 5 is a block diagram of a control device for a color electrophotographic device according to the present invention.

FIG. 5 shows a block diagram of a control device which effects the controls for the respective processes as explained above.

The control device is principally composed of a CPU 101, a ROM 102 which stores control programs for the CPU 101 and a RAM which serves as a work memory necessary for executing the control programs.

An input and output interface (I/F) 104 inputs data for printing generated from a host computer 50 into an exposure controller 105 wherein the electrical signals are converted into corresponding optical signals to form the exposure beam 4. Further, a mechanism controller 106 controls the operation and rest of the mechanisms for the various processes such as the cleaner 12 in the cleaning process.

A motor controller 200 controls a motor 31 which drives the photo sensitive drum 1, fixing unit 11 and transferring roller 15 involved in the transferring speed changing control, and receives a motor drive command signal 201 and a speed command signal 202 from the mechanism controller 106. An encoder 32 is directly coupled to the rotating shaft of the motor 31 in order to detect angular displacement amounts of the motor 31 and the output from the encoder 32 is fed back to the motor controller 200 and is also input to the CPU 101 as a rotation angle signal 203 via an interruption controller 107.

Figure 6:
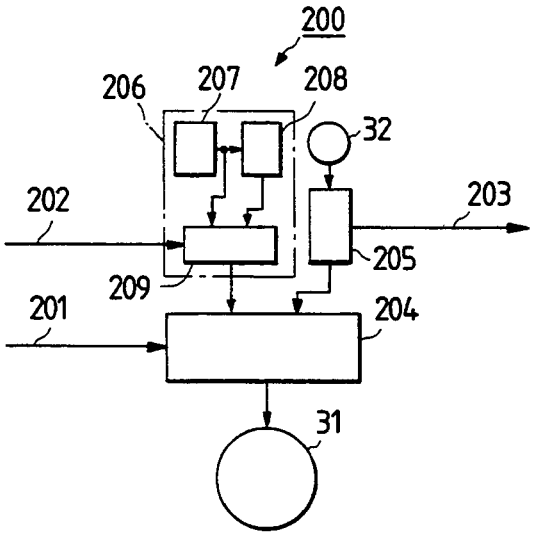
FIG. 6 is a block diagram of a motor control unit in the control device shown in FIG. 5.

The constitution of the motor controller 200 is explained with reference to FIG. 6.

The motor controller 200 comprises a PLL (Phase Locked Loop) controller 204 performing a PLL control based on signals from a reference clock source 206 and signals obtained from the encoder 32 via a wave shaping unit 205. The PLL controller 204 receives the motor drive command signal 201 and controls the driving and stopping of the motor 31 in response to the signal 201. Further, the reference clock source 206 comprises an oscillator source 207, a dividing circuit 208 which divides a first reference clock from the oscillator source 207 and a selection circuit 209 which selects either the first reference clock from the oscillator source 207 or a second reference clock from the dividing circuit 208 dependent upon the speed command signal 202. Further, the rotation angle signal 203 of the photo sensitive drum 1 is outputted via the wave shaping circuit 205, such that the motor controller 200 is constituted so that the CPU 101 can correctly recognize the angular displacement amount of the photo sensitive drum 1 even in a transient period during changing of the transferring speed of the motor 31 in response to the speed command signal 202.

According to the present embodiment, in the course of a color picture image production on a transparent sheet via a multi overlaid development method, with the addition of a process for performing one idle rotation of the photo sensitive drum 1, the transferring speed for the transparent sheet is reduced without adversely affecting other processes and a desirable color picture image is obtained. Further, since only the transferring speed during the image transferring process and the fixing process is reduced to a desired speed, the color toner image producing time is not prolonged much in comparison with an instance where the processing speeds of all the processes are reduced. Still further, the transferring station and the fixing station can be arranged without any restrictions with respect to their physical distance, thereby a color electrophotographic device of low cost and of small size is obtained.

Figure 3:
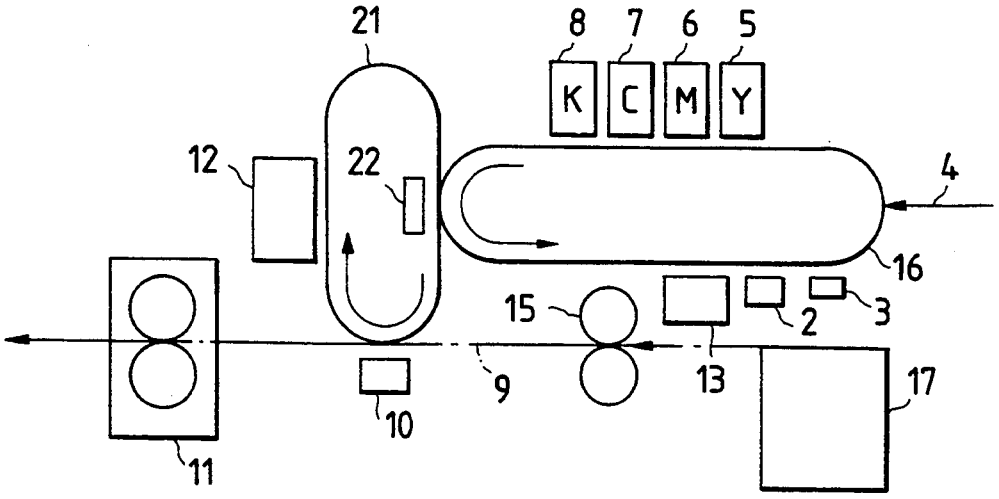
FIG. 3 is a schematic vertical cross sectioned side view of another embodiment of a color electrophotographic device employing an intermediate image transferring method in a form of a laser beam printer according to the present invention.
Figure 4A:
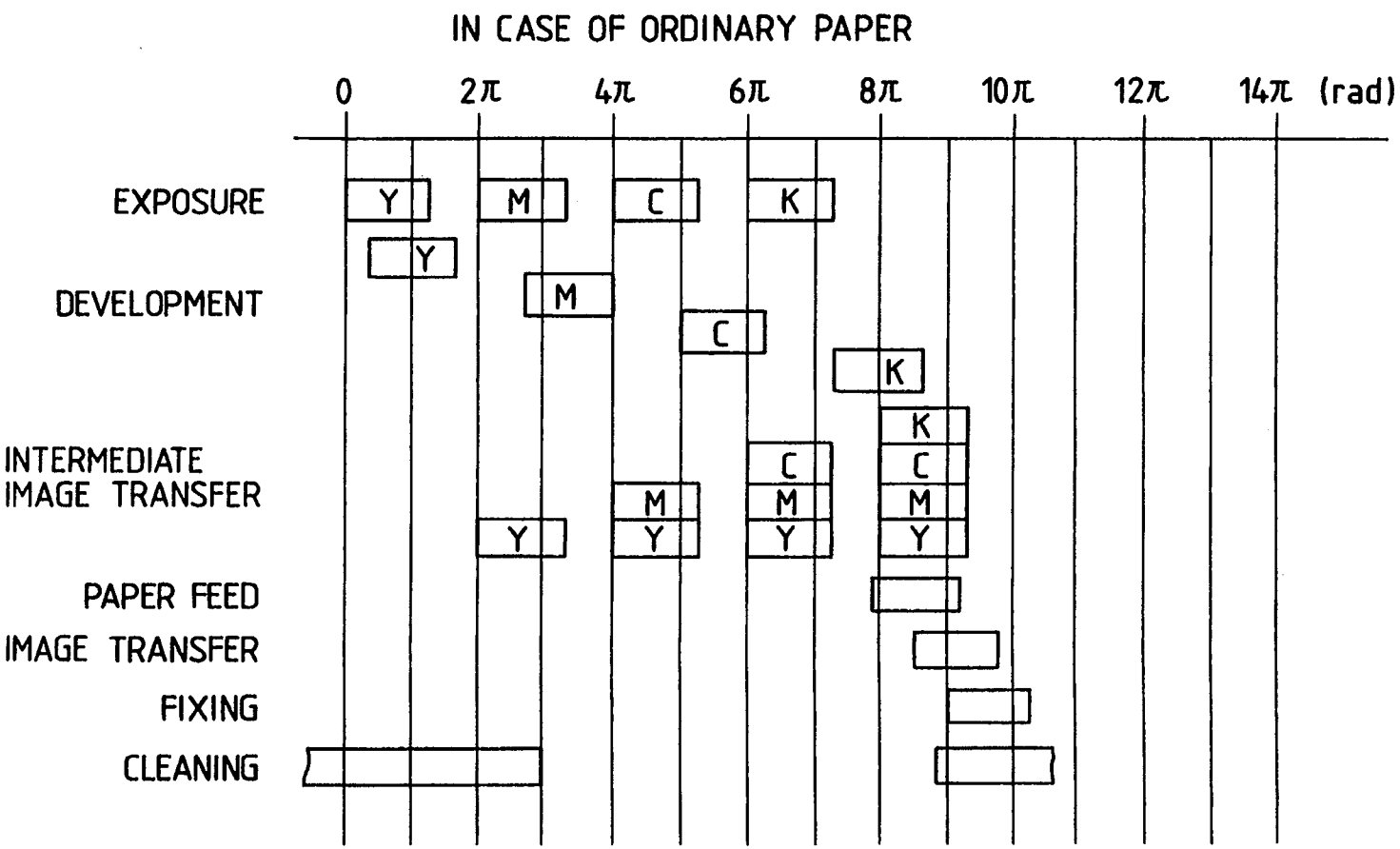
FIG. 4 (*a*) shows a timing chart with regard to the operation in case of an ordinary paper of the laser beam printer shown in FIG. 3.
Figure 4B:
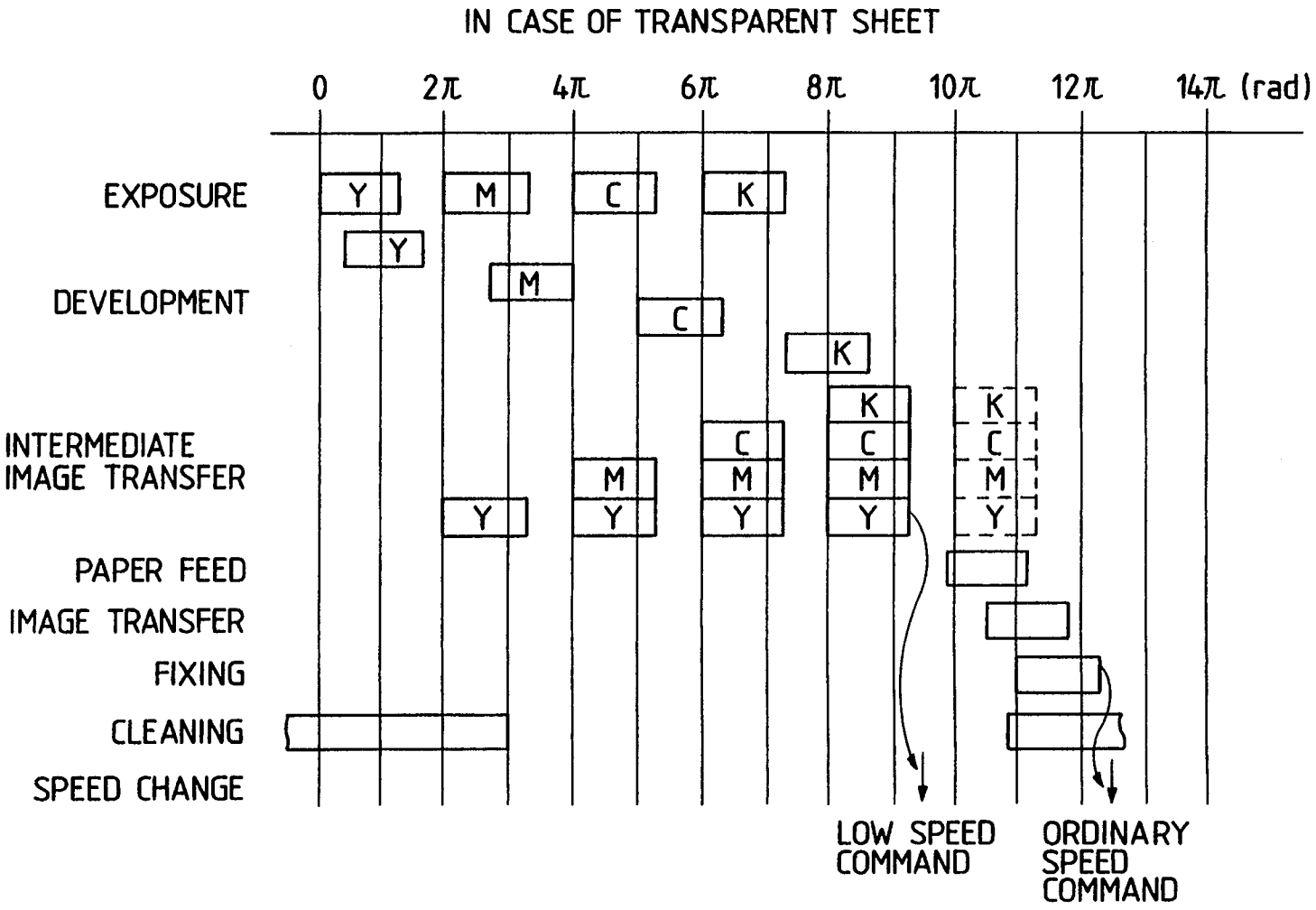

Hereinafter, another embodiment of the present invention is explained with reference to FIG. 3, FIG. 4 (*a*) and FIG. 4 (*b*). FIG. 3 is a vertical cross sectioned side view of a laser beam printer constituting a color electrophotographic device employing an intermediate image transferring method, and FIG. 4 (*a*) and FIG. 4 (*b*) show operation timing charts of the laser beam printer. In the timing charts shown in FIG. 4 (*a*) and FIG. 4 (*b*) the time axis represents the rotation angle of an intermediate image transfer belt 21 and one rotation thereof corresponds to an angle $2\pi$. Further, the belt lengths of the intermediate image transfer belt 21 and a photo sensitive belt 16 are determined in such a manner that when the intermediate image transfer belt 21 rotates twice (rotating angle of $4\pi$) the photo sensitive belt 16 rotates once.

At first, the remaining charge on the surface of the photo sensitive belt 16 is neutralized by a charge eliminator 2, and thereafter the surface is uniformly charged with a charger 3. When the rotating angle is zero, an exposure is initiated by an exposure beam 4 which is then modulated with data relating to a Y color and a latent image formed by the exposure is developed by a Y developer 5 to form a Y series toner image. The Y series toner image thus formed is intermediately transferred onto the intermediate image transfer belt 21 via an intermediate image transfer unit 22 at the moment when the intermediate image transfer belt 21 rotates by angle $2\pi$. Before the top end of the Y series toner image reaches the cleaner 12 (at rotating angle of $3\pi$), the cleaner 12 is retreated so as not to erase the color toner images which are formed on the intermediate image transfer belt 21 via the color toner image forming processes. A cleaner 13 is always rendered operative so as to remove the residual toner on the photo sensitive belt 16 after a color toner image has been transferred.

Subsequently, at the second rotation (rotating angle of $2\pi$) an exposure is initiated by an exposure beam 4 which is modulated with data relating to an M color, a latent image formed by the exposure is developed by an M developer 6 to form an M series toner image, and at the moment when the rotating angle reaches $4\pi$, the M series toner image thus formed is intermediately transferred in a multi overlaid manner onto the intermediate image transfer belt 21 via the intermediate transfer unit 22.

Thereafter, at the third rotation (rotating angle of $4\pi$) an exposure is initiated by an exposure beam 4 which is then modulated with data relating to a C color, a latent image formed by the exposure is developed by a C developer 7 to form a C series toner image, and at the moment when the rotating angle reaches $6\pi$, the C series toner image thus formed is intermediately transferred in a multi overlaid manner onto the intermediate image transfer belt 21 via the intermediate transfer unit 22.

Finally, at the fourth rotation (rotating angle of $6\pi$) an exposure is initiated by an exposure beam 4 which is modulated with data relating to a K color, a latent image formed by the exposure is developed by a K developer 8 to form a K toner image, and at the moment when the rotating angle reaches $8\pi$, the K toner image thus formed is intermediately transferred in a multi overlaid manner onto the intermediate image transfer belt 21 via the intermediate transfer unit 22.

Through the above respective processes, a four color toner image is formed on the intermediate image transfer belt 21.

Thereafter, a synchronization control is performed by a transferring roller 15 so that a transferring timing of a secondary recording medium passing through a recording medium transferring passage a matches with the four color toner image on the intermediate image transfer belt 21. However, the manner of control differs in the case when an ordinary paper is used as the secondary recording medium and in the case when a transparent sheet is used as the secondary recording medium.

In the case when an ordinary paper is used as the secondary recording medium, in order to match the top end of the four color toner image which appears at the position of an image transferring unit 10 when the intermediate image transfer belt 21 rotates by rotating angle of $8.5\pi$, the transferring timing of the ordinary paper is synchronized to thereby transfer the four color toner image onto the ordinary paper via the image transferring unit 10. Thereafter, the four color toner image is fixed on the ordinary paper via a fixing unit 11 to obtain a color picture image printed matter. Then the retreated cleaner 12 is rendered operative to remove residual toner on the intermediate image transfer belt 21 which has completed the transferring of the four color toner image onto the ordinary paper.

On the other hand, in the case when a transparent sheet is used, it is necessary to provide a sufficiently large energy in the fixing process in comparison with that required for the ordinary paper. As explained above, the control for the transparent sheet is performed by decreasing the transferring speed thereof.

However, when the transferring speed is simply reduced to a desired speed at the moment when the intermediate image transfer belt 21 reaches the rotating angle of $8.5\pi$, the intermediate image transferring process for the K toner image which is being performed at that time is affected because the rotating speed of the intermediate image transfer belt 21 is simultaneously reduced. Therefore, the speed reduction at this rotation is prevented and after the completion of the intermediate image transferring process for the K toner image the transferring speed is reduced to the desired speed and the device waits for the top end of the four color toner image to arrive at the position of the image transferring unit 10 in the subsequent rotation. Since the intermediate image transfer belt 21 is caused to perform one idle rotation, the timing when the cleaner 12 is again rendered operative is controlled to be delayed by the interval corresponding to the one idle rotation to prevent the four color toner image from being erased.

Then the transferring of a transparent sheet is initiated in synchronization with the rotation of the intermediate image transfer belt 21 in order to match the top end of the four color toner image which appears again at the position of the image transferring unit 10 when the intermediate image transfer belt 21 rotates by rotation angle of $10.5\pi$, and the four color toner image is transferred onto the transparent sheet via the transferring unit 10. Thereafter, the four color toner image is fixed on the transparent sheet at the reduced transferring speed via the fixing unit 11 and a color picture image having of an increased transmission factor for the non-scattering light is produced on the transparent sheet. After completing all the processes (or in particular the fixing process) for the transparent sheet, the transferring speed is controlled to be set back to an ordinary speed determined for the ordinary paper.

A control device for controlling the respective processes explained above is substantially the same as that explained with reference to FIG. 5 and FIG. 6 except that the motor 31 drives the intermediate image transfer belt 21 in addition to the photo sensitive belt 16, the fixing unit 11 and the transferring roller 15.

According to the present embodiment, in the course of a color picture image production on a transparent sheet via an intermediate image transferring method, with the addition of a process for causing the intermediate image transfer belt 21 to perform one idle rotation, the transferring speed for the transparent sheet is reduced without adversely affecting other processes and a desirable color picture image is obtained. Further, since only the transferring speed during the image transferring process and the fixing process is reduced to a desired speed, the color toner image producing time is not prolonged much in comparison with an instance where the processing speeds of all the processes are reduced. Still further, the transferring station and the fixing station can be arranged without any restrictions with respect to their physical distance, thereby a color electrophotographic device of low cost and of small size is obtained.

According to the present invention, in the course of a color picture image production on a transparent sheet, with the addition of a process causing the color toner image production medium carrying a color toner image, to perform one idle cycle during which the transferring speed for the transparent sheet is reduced without adversely affecting other processes, a desirable color picture image is obtained. Further, since only the transferring speed during the image transferring process and the fixing process is reduced to a desired speed, the color toner image producing time is not prolonged much in comparison with an instance where the processing speeds of all the processes are reduced. Still further, the transferring station and the fixing station can be arranged without any restrictions with respect to their physical distance, thereby a color electrophotographic device of low cost and of small size is obtained.

We claim:

1. A color electrophotographic device comprising:

color toner image producing means for producing a color toner image on a rotatable first recording medium by forming multiple toner images thereon;

image transferring means for transferring the color toner image on the first recording medium onto a second recording medium;

fixing means for fixing the color toner image on the second recording medium;

second recording medium transferring means for transferring the second recording medium past said color toner image producing means, said image transferring means, and said fixing means;

recording medium selecting and feeding means for selecting one of an ordinary paper and a transparent sheet as the second recording medium and for feeding the selected one of the ordinary paper and the transparent sheet to said second recording medium transferring means; and control means for controlling said color toner image producing means, said image transferring means, said fixing means, said second recording medium transferring means, and said recording medium selecting and feeding means;

wherein said control means includes:

first control function means operative when the transparent sheet is selected as the second recording medium for causing the first recording medium to perform at least one idle rotation before the image transferring means begins to transfer the color toner image on the first recording medium onto the transparent sheet; and second control function means operative when the transparent sheet is selected as the second recording medium for causing the second recording medium transferring means to reduce a transferring speed of the second recording medium transferring means for the transparent sheet during operation of the image transferring means and the fixing means relative to a transferring speed of the second recording medium transferring means for the ordinary paper; and wherein the second control function means causes the second recording medium transferring means to reduce the transferring speed of the second recording medium transferring means for the transparent sheet after the color toner image producing means has completed formation of a last toner image of the multiple toner images on the first recording medium and while the first recording medium is performing the at least one idle rotation under control of the first control function means.

2. A color electrophotographic device according to claim 1, wherein the second control function means causes the second recording medium transferring means to reduce the transferring speed of the second recording medium transferring means for the transparent sheet during operation of said image transferring means and said fixing means to less than 75 mm/sec.

3. A color electrophotographic device according to claim 1, wherein the second control function means causes the second recording medium transferring means to restore the transferring speed of the second recording medium transferring means to a transferring speed for the ordinary paper after said fixing means has completed fixing the color toner image on the transparent sheet.

4. A color electrophotographic device comprising:

toner image producing means for forming a plurality of toner images of different colors on a rotatable first recording medium;

color toner image producing means for producing a color toner image by transferring the toner images of different colors formed on the first recording medium onto an intermediate image transferring medium in an overlaid manner;

image transferring means for transferring the color toner image on the intermediate image transferring medium onto a second recording medium;

fixing means for fixing the color toner image on the second recording medium;

second recording medium transferring means for transferring the second recording medium past said color toner image producing means, said image transferring means, and said fixing means;

recording medium selecting and feeding means for selecting one of an ordinary paper and a transparent sheet as the second recording medium and for feeding the selected one of the ordinary paper and the transparent sheet to said second recording medium transferring means; and control means for controlling said toner image producing means, said color toner image producing means, said image transferring means, said fixing means, said second recording medium transferring means, and said recording medium selecting and feeding means;

wherein said control means includes:

first control function means operative when the transparent sheet is selected as the second recording medium for causing the intermediate image transferring medium to perform at least one idle rotation before the image transferring means begins to transfer the color toner image on the intermediate image transferring medium onto the transparent sheet; and second control function means operative when the transparent sheet is selected as the second recording medium for causing the second recording medium transferring means to reduce a transferring speed of the second recording medium transferring means for the transparent sheet during operation of the image transferring means and the fixing means relative to a transferring speed of the second recording medium transferring means for the ordinary paper; and wherein the second control function means causes the second recording medium transferring means to reduce the transferring speed of the second recording medium transferring means for the transparent sheet after the toner image producing means has completed formation of a last toner image of the toner images of different colors on the intermediate image transferring medium and while the intermediate image transferring medium is performing the at least one idle rotation under control of the first control function means.

5. A color electrophotographic device according to claim 4, wherein the second control function means causes the second recording medium transferring means to reduce the transferring speed of the second recording medium transferring means for the transparent sheet during operation of said image transferring means and said fixing means to less than 75 mm/sec.

6. A color electrophotographic device according to claim 4, wherein the second control function means causes the second recording medium transferring means to restore the transferring speed of the second recording medium transferring means to a transferring speed for the ordinary paper after said fixing means has completed fixing the color image on the transparent sheet.

7. A color electrophotographic method comprising the steps of:

producing a color toner image by overlaying a plurality of toner images of different colors on a rotatable color toner image carrying medium;

selecting one of an ordinary paper and a transparent sheet as a recording medium for producing a color picture image thereon;

feeding the selected one of the ordinary paper and the transparent sheet to a transferring station;

transferring the fed recording medium to an image transferring station;

transferring the color toner image on the rotatable color toner image carrying medium onto the transferred recording medium;

fixing the transferred color toner image on the recording medium;

causing the rotatable color toner image carrying medium to perform at least one idle rotation before beginning said color toner image transferring step when the transparent sheet is selected as the recording medium; and reducing the transferring speed of the recording medium during said color toner image transferring step and said fixing step when the transparent sheet is selected as the recording medium relative to a transferring speed for the ordinary paper;

wherein the step of reducing the transferring speed of the recording medium during said color toner image transferring step and said fixing step when the transparent sheet is selected as the recording medium is begun after a last toner image of the plurality of toner images of different colors has been overlaid on the rotatable color toner image carrying medium and while the rotatable color toner image carrying medium is performing the at least one idle rotation.

* * * * *